US010837300B2

(12) United States Patent
Maud et al.

(10) Patent No.: US 10,837,300 B2
(45) Date of Patent: Nov. 17, 2020

(54) SEAL PRESSURIZATION IN BOX SHROUD

(71) Applicant: General Electric Company, Schenectady, NY (US)

(72) Inventors: Karen Kokal Maud, Greenville, SC (US); Russell DeForest, Greenville, SC (US); Robert W. Coign, Greenville, SC (US); Dipankar Pal, Greenville, SC (US)

(73) Assignee: General Electric Company, Schenectady, NY (US)

( * ) Notice: Subject to any disclaimer, the term of this patent is extended or adjusted under 35 U.S.C. 154(b) by 953 days.

(21) Appl. No.: 15/340,733

(22) Filed: Nov. 1, 2016

(65) Prior Publication Data

US 2018/0230838 A1 Aug. 16, 2018

(51) Int. Cl.

| | |
|---|---|
| ***F01D 11/00*** | (2006.01) |
| ***F01D 5/08*** | (2006.01) |
| ***F01D 25/12*** | (2006.01) |
| ***F01D 11/04*** | (2006.01) |
| *F01D 11/24* | (2006.01) |

(52) U.S. Cl.

CPC ..... *F01D 11/005* (2013.01); *F01D 5/081* (2013.01); *F01D 11/04* (2013.01); *F01D 25/12* (2013.01); *F01D 11/24* (2013.01); *F05D 2240/11* (2013.01); *F05D 2240/55* (2013.01)

(58) Field of Classification Search

CPC ..... F01D 11/005; F01D 25/12; F01D 25/246; F01D 5/081; F01D 9/041; F01D 11/04; F01D 11/24; F05D 2240/11; F05D 2240/55; F05D 2260/20; F05D 2260/202; F02C 7/28

See application file for complete search history.

(56) References Cited

U.S. PATENT DOCUMENTS

| | | | | |
|---|---|---|---|---|
| 5,088,888 | A | 2/1992 | Bobo | |
| 5,127,793 | A * | 7/1992 | Walker | F01D 11/08 415/115 |
| 6,340,285 | B1 | 1/2002 | Gonyou et al. | |
| 6,354,795 | B1 * | 3/2002 | White | F01D 11/24 415/116 |
| 8,353,663 | B2 | 1/2013 | Arzel et al. | |
| 8,678,754 | B2 | 3/2014 | Morgan et al. | |
| 8,684,680 | B2 | 4/2014 | Martin et al. | |
| 8,814,507 | B1 | 8/2014 | Campbell et al. | |

* cited by examiner

*Primary Examiner* — Kenneth J Hansen
*Assistant Examiner* — Julian B Getachew
(74) *Attorney, Agent, or Firm* — Nixon & Vanderhye P.C.

(57) ABSTRACT

A shroud segment arranged radially outward of a gas flow path of a gas turbine. The shroud segment includes a body having walls defining an internal pocket for receiving a supply of air. A plurality of pressurization apertures is formed through one of the walls to fluidly connect an internal pocket of the body to an ambient area of the body. A seal slot section is formed in the wall at a position radially inward of the pressurization apertures to receive a seal to connect the shroud segment to an adjacent shroud segment. The pressurization apertures are arranged such that portions of the supply of air are configured to pass through the pressurization apertures and through the seal slot section as leakage into the gas flow path, thereby reducing ingestion of fluid from the gas flow path into the internal pocket of the shroud segment.

18 Claims, 3 Drawing Sheets

SEAL PRESSURIZATION IN BOX SHROUD

TECHNICAL FIELD

This invention relates generally to gas turbines, and more particularly to seals between components of a gas turbine, such as turbine shroud segments.

BACKGROUND

In a gas turbine, a combustor converts chemical energy of a fuel or an air-fuel mixture into thermal energy. The thermal energy is eventually converted to mechanical energy as exhaust gases pass through the turbine. The gases force one or more turbine blades to rotate a shaft along an axis of the system. The shaft may be connected to various components of the turbine system, including a compressor. The compressor also includes blades that may be coupled to the shaft. As the shaft rotates, the blades within the compressor also rotate, thereby compressing air from an air intake through the compressor and into the fuel nozzles and/or combustor. Air may be bled off from the compressor to cool various components of the turbine. For example, compressor air may be bled off to cool a turbine shroud. The cooling air may also be used to pressurized seals between segments of the shroud.

BRIEF SUMMARY

One exemplary but nonlimiting aspect of the disclosed technology relates to a shroud segment for a turbomachine comprising a body configured to be positioned radially outward of a gas flow path of the turbomachine, said body having a plurality of walls defining an internal pocket for receiving a supply of air; at least one pressurization aperture formed in at least one wall of the plurality of walls, the at least one pressurization aperture fluidly connecting the internal pocket to an ambient area of the body; and at least one seal slot section formed in the at least one wall at a position radially inward of the at least one pressurization aperture, wherein the at least one pressurization aperture is arranged such that portions of the supply of air are configured to pass through the pressurization aperture and through the at least one seal slot section as leakage into the gas flow path, thereby reducing ingestion of fluid from the gas flow path into the internal pocket.

Another aspect of the disclosed technology relates to a shroud assembly for a turbomachine adapted to be positioned radially outward of a gas flow path of the turbomachine comprising a first shroud segment having a first body including: 1) a first hollow internal pocket for receiving a first supply of air, and 2) at least one first pressurization aperture formed in at least one wall of the first body to fluidly connect the first internal pocket to an ambient area of the first body; a second shroud segment positioned adjacent the first shroud segment and forming an intersegment cavity therebetween, the second shroud segment having a second body including: 1) a second hollow internal pocket for receiving a second supply of air, and 2) at least one second pressurization aperture formed in at least one wall of the second body to fluidly connect the second internal pocket to an ambient area of the second body; and a seal positioned in the intersegment cavity at a position radially inward of the at least one first pressurization aperture and the at least one second pressurization aperture, wherein the first supply of air and the second supply of air pressurize the seal, respectively, via the at least one first pressurization aperture and the at least one second pressurization aperture such that portions of the first supply of air and the second supply of air are configured to flow past the seal as leakage into the gas flow path, thereby reducing ingestion of fluid from the gas flow path into the first internal pocket and/or the second internal pocket.

Other aspects, features, and advantages of this technology will become apparent from the following detailed description when taken in conjunction with the accompanying drawings, which are a part of this disclosure and which illustrate, by way of example, principles of this invention.

BRIEF DESCRIPTION OF THE DRAWINGS

The accompanying drawings facilitate an understanding of the various examples of this technology. In such drawings.

DETAILED DESCRIPTION OF THE ILLUSTRATED EMBODIMENTS

Figure 1:
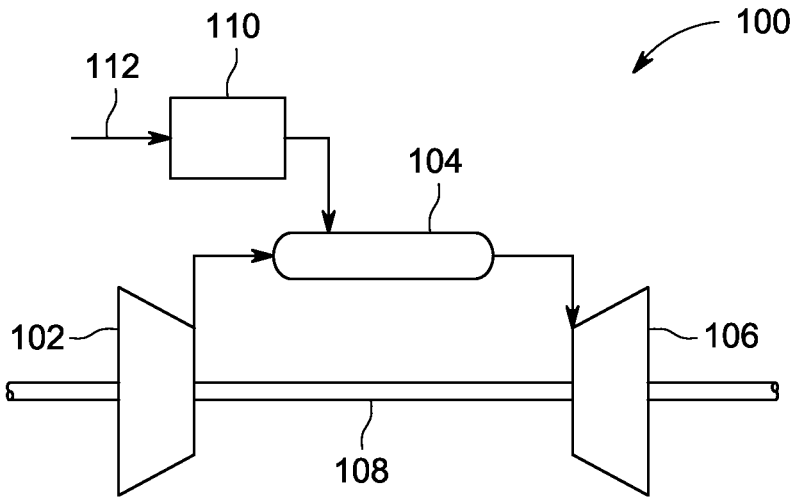
FIG. 1 is a schematic representation of a gas turbine engine, including; a combustor, fuel nozzle, compressor and turbine according to an example of the disclosed technology.

FIG. 1 is a schematic diagram of an exemplary turbomachine, e.g., a gas turbine system 100. The system 100 includes a compressor 102, a combustor 104, a turbine 106, a shaft 108 and a fuel nozzle 110. In another example, the system 100 may include a plurality of compressors 102, combustors 104, turbines 106, shafts 108 and fuel nozzles 110. The compressor 102 and turbine 106 are coupled by the shaft 108. The shaft 108 may be a single shaft or a plurality of shaft segments coupled together to form shaft 108.

The combustor 104 may use liquid and/or gas fuel, such as natural gas or a hydrogen rich synthetic gas, to run the engine. For example, fuel nozzles 110 are in fluid communication with an air supply and a fuel supply 112. The fuel nozzles 110 create an air-fuel mixture, and discharge the air-fuel mixture into the combustor 104, thereby causing a combustion that heats a pressurized gas. The combustor 104 directs the hot pressurized exhaust gas through a transition piece into a turbine nozzle (or "stage one nozzle") and then a turbine bucket, causing turbine 106 to rotate. The rotation of turbine 106 causes the shaft 108 to rotate, thereby compressing the air as it flows into the compressor 102. The turbine components or parts are joined by seals or seal assemblies configured to allow for thermal expansion and relative movement of the parts while preventing leakage of the gas. Specifically, reducing leakage of compressed gas flow between turbine components increases hot gas flow along the desired path, enabling work to be extracted from more of the hot gas, leading to improved turbine efficiency. Seals and seal assemblies for placement between turbine parts are discussed in detail below with reference to FIGS. 2-4.

Figure 2:
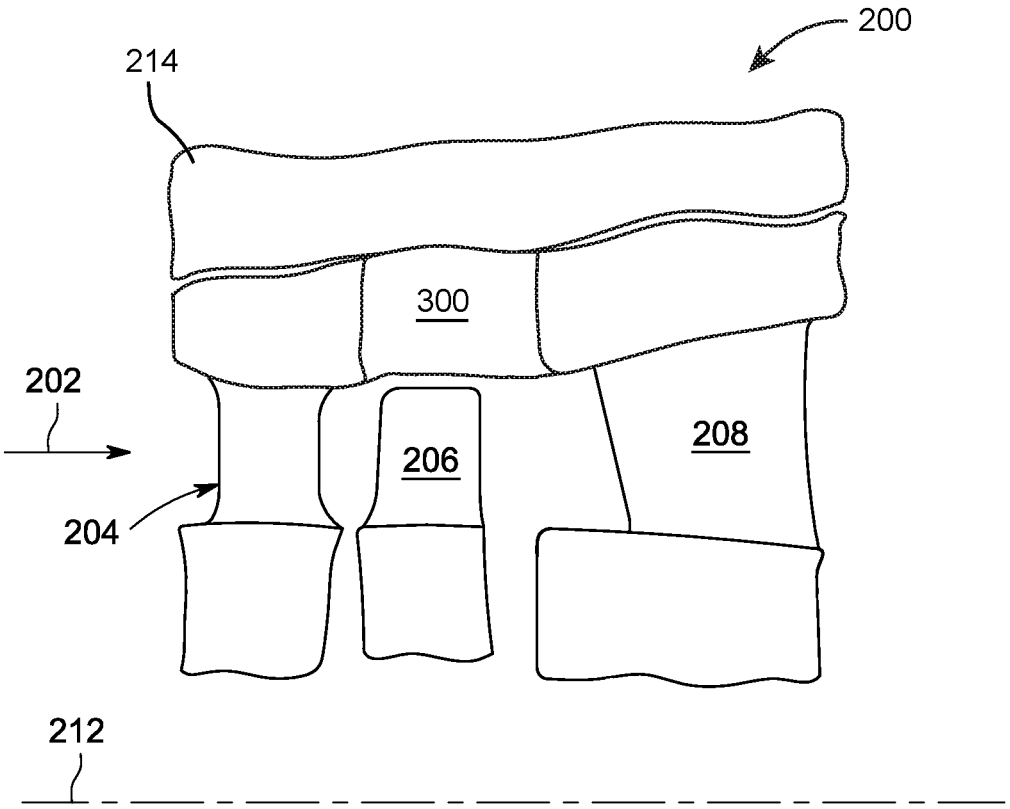
FIG. 2 is a side view of a portion of a gas turbine, including a shroud segment and other components along a hot gas path, in accordance with an example of the disclosed technology.

FIG. 2 is a side view of a portion of a gas turbine 200, showing components along a hot gas path 202 or flow. The gas turbine 200 includes a nozzle 204 (upstream static nozzle), bucket 206 (also called a "blade" or "vane"), nozzle 208 (downstream static nozzle) and shroud segment 300 (connected to turbine shell 214), wherein the hot gas 202 flows through the vane or airfoil-shaped nozzles and buckets to cause rotation of rotors about an axis 212. As depicted, the bucket 206 and shroud segment 300 are part of a rotor assembly between two stators, wherein the stator assemblies include nozzles 204 and 208. The nozzle 204 and bucket 206 are described as stage one components, while nozzle 208 is a stage two component of the turbine 200.

Figure 3:
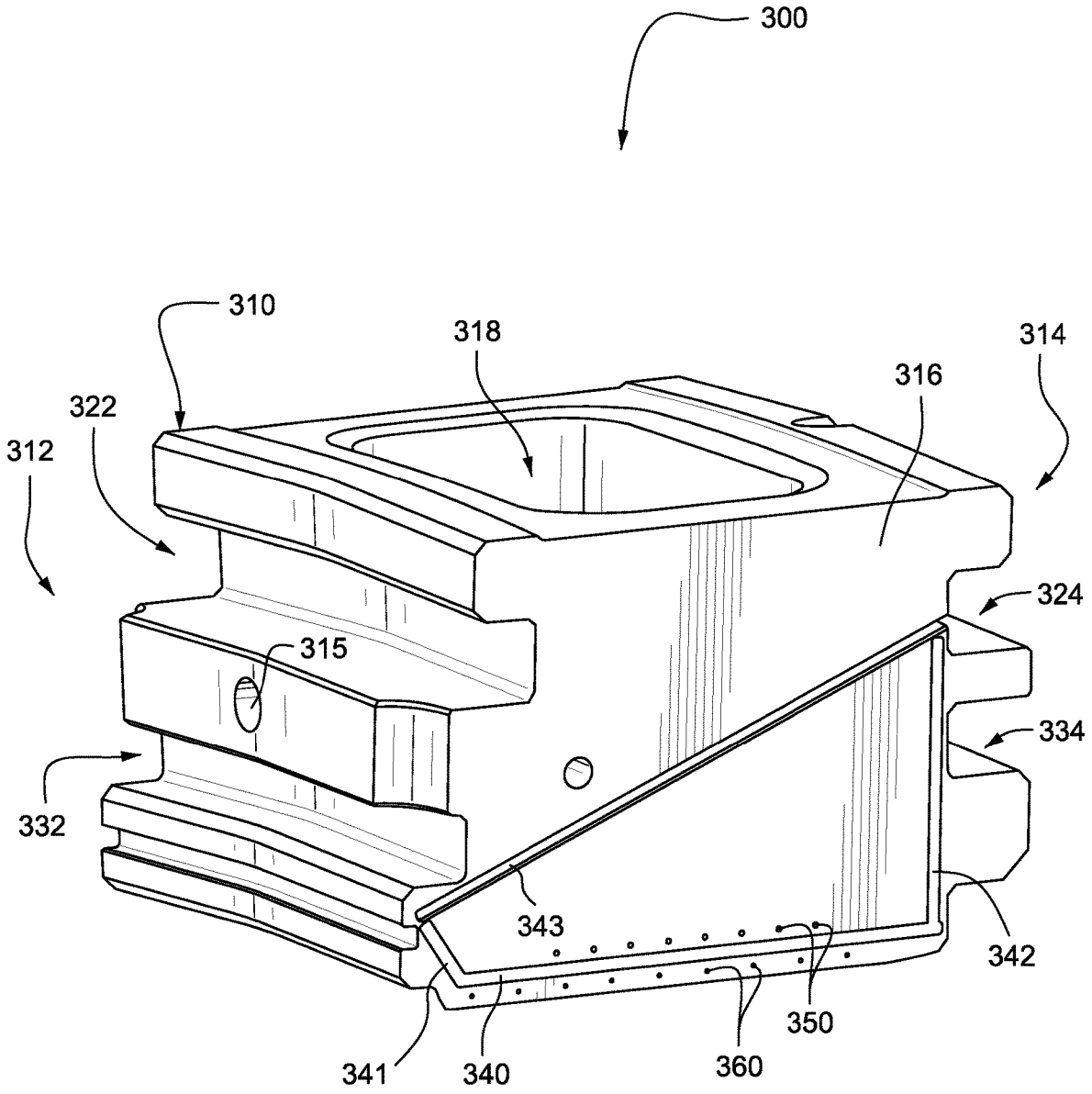
FIG. 3 is a perspective view of the shroud segment of FIG. 2 according to an example of the disclosed technology.

Turning to FIG. 3, shroud segment 300 is shown. Shroud segment 300 is generally box-shaped and includes a body 310. Body 310 includes an upstream side 312 and a downstream side 314. Shroud segment 300 may be constructed from any suitable material (e.g. stainless steel), as those skilled in the art will recognize.

The upstream side 312 of shroud segment 300 includes upstream static interface structure 332 and upstream turbine shell interface structure 322. The upstream static interface structure 332 is configured to connect the shroud segment 300 to the upstream static nozzle 204, whereas the upstream turbine shell interface structure 322 is configured to connect the shroud segment 300 to an upstream portion of turbine shell 214. However, as those in the art will recognize, the gas turbine may have a different arrangement.

The downstream side 314 of shroud segment 300 includes downstream static interface structure 334 and downstream turbine shell interface structure 324. The downstream static interface structure 334 is configured to connect the shroud segment to the downstream static nozzle 208, whereas the downstream turbine shell interface structure 324 is configured to connect the shroud segment 300 to a downstream portion of the turbine shell.

Shroud segment 300 is positioned radially outward of hot gas path 202, as shown in FIG. 2. A plurality of shroud segments are positioned one adjacent another in a circumferential direction of the turbine to form an annulus shroud structure about the hot gas path. That is, sidewall 316, shown in FIG. 3, is configured to be positioned adjacent a side wall of an adjacent shroud segment in a circumferential direction of the turbine. An opposite side of shroud segment 300 also includes a sidewall 316 and is configured to be positioned adjacent a sidewall of an adjacent shroud segment in a circumferential direction of the turbine.

As shown in FIG. 3, a seal slot may include a plurality of seal slot sections 340, 341, 342, 343 is formed in the sidewall 316. Those skilled in the art will recognize that the seal slot may have a different configuration. As shown in FIG. 3, the seal slot may include a bottom section 340, opposing side sections 341, 342 respectively extending adjacent the upstream side 312 and the downstream side 314 of body 310, and a diagonal section 343 extending between the side sections.

Figure 4:
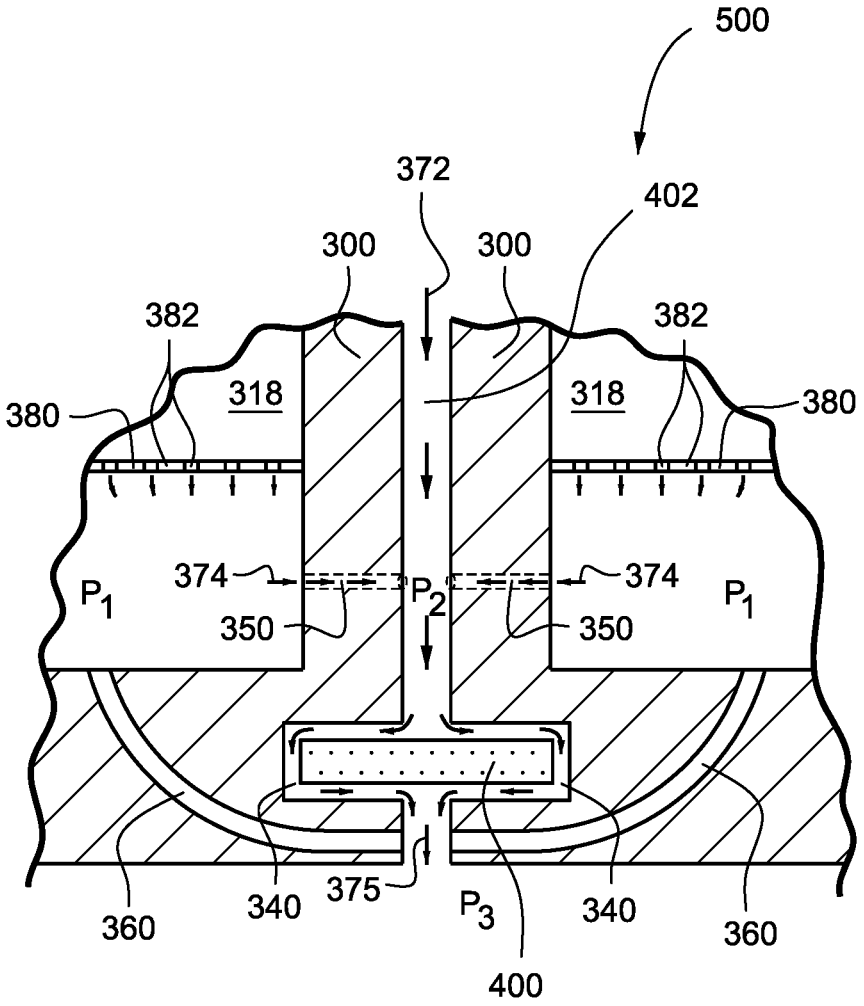
FIG. 4 is a partial cross-sectional view of a shroud assembly according to an example of the disclosed technology.

Turning to FIG. 4, a shroud assembly 500 includes adjacent shroud segments 300 connected by a seal 400. Seal 400 may be constructed from any suitable material (e.g., stainless steel), as those skilled in the art will recognize. An intersegment cavity 402 is formed between the shroud segments 300 and comprises the seal slot sections 340, 341, 342, 343 formed in each shroud segment.

Turning back to FIG. 3, body 310 of shroud segment 300 has an internal pocket 318 formed therein. Upstream side 312 includes a feed hole 315 fluidly connected to the internal pocket to provide a supply of air thereto. Those skilled in the art will recognize that more than one feed hole may be provided. The air provided to the internal pocket may be air bled off from the compressor as circulation air used to cool various turbine components and/or to seal the hot gas path.

As can been seen in FIG. 3, a plurality of pressurization apertures 350 are formed through the sidewall 316 at a position radially outward of the bottom section 340 of the seal slot. Those skilled in the art will recognize that the pressurization apertures could be formed as round holes, slots or any other suitable configuration. The pressurization apertures 350 are in fluid communication with the internal pocket 318. It is also noted that a plurality of cooling apertures 360 are formed through the sidewall 316 at a position radially inwardly of the bottom section of the seal slot 340. The cooling apertures 360 are also in fluid communication with the internal pocket 318 and are configured to pass cooling air through the shroud segments to cool the segments.

Turning to FIG. 4, the supply of air provided to the internal pocket 318 flows through the pressurization apertures 350 and into the intersegment cavity 402 to pressurize the seal 400. A metering plate 380 extends across the internal pocket 318 and includes a plurality of metering holes 382 such that the supply of air flows through the metering holes before reaching the pressurization apertures. The metering plate 340 is configured to more uniformly distribute the supply of air to the pressurization apertures 350.

Referring to FIG. 4, residual cooling flow 372 from surrounding turbine components tends to flow radially inward in the intersegment cavity 402. The pressure Pi in the internal pocket may be adjusted by altering the pressurization apertures 350. That is, the size and/or number of pressurization apertures 350 may be adjusted to meter the pressurization flow 374 as desired, thereby controlling the pressure P2. It is desirable that pressure P2 is greater than pressure P3 in the gas flow path so that the pressurization flow 374 is caused to exit the shroud segments 300 and flow towards the seal 400.

When P2 is greater than P3, the pressurization flow 374 will flow through the bottom section 340 of the seal slot and exit the intersegment cavity 402 into the gas path flow as leakage 375. This arrangement is desirable as it prevents ingestion of fluid from the gas flow path into the internal pockets 318 of the shroud segments 300.

It is noted that each shroud segment 300 is essentially self-contained since air does not flow from one shroud segment to another shroud segment. By this arrangement, a leakage issue in one shroud segment will not necessarily affect the other shroud segments.

While the invention has been described in connection with what is presently considered to be the most practical and preferred examples, it is to be understood that the invention is not to be limited to the disclosed examples, but on the contrary, is intended to cover various modifications and equivalent arrangements included within the spirit and scope of the appended claims.

What is claimed is:

1. A shroud segment for a turbomachine, comprising:

a single one-piece body configured to be positioned radially outward of a gas flow path of the turbomachine, said single one-piece body having a plurality of walls defining an internal pocket for receiving a supply of air;

at least one pressurization aperture formed in at least one wall of the plurality of walls, the at least one pressurization aperture fluidly connecting the internal pocket to an ambient area of the body, the at least one pressurization aperture having an outlet formed in an exterior surface of the at least one wall;

at least one seal slot section formed in the at least one wall at a position radially inward of the outlet of the at least one pressurization aperture; and at least one feed hole to provide the supply of air to the internal pocket, the at least one feed hole formed in an upstream face of the body, wherein the body includes an upstream static interface structure connected to an upstream static nozzle of the turbomachine, the upstream static interface structure formed in the upstream face of the body at a position radially inward of the at least one feed hole, and wherein the at least one pressurization aperture is arranged such that portions of the supply of air are configured to pass through the at least one pressurization aperture and through the at least one seal slot section as leakage into the gas flow path, thereby reducing ingestion of fluid from the gas flow path into the internal pocket.

2. The shroud segment of claim 1, wherein the at least one pressurization aperture is configured such that a pressure in the internal pocket is greater than a pressure in a portion of the gas flow path adjacent the body to facilitate the leakage into the gas flow path.

3. The shroud segment of claim 2, wherein a size of the at least one pressurization aperture affects a flow of the supply of air through the at least one seal slot section.

4. The shroud segment of claim 3, wherein the at least one pressurization aperture comprises a plurality of pressurization apertures.

5. The shroud segment of claim 4, further comprising a metering plate positioned in the internal pocket and having a plurality of metering holes formed therein.

6. The shroud segment of claim 5, wherein the metering plate is arranged such that the supply of air flows through the metering holes to control a distribution of the supply of air to the plurality of pressurization apertures.

7. The shroud segment of claim 1, further comprising at least one cooling aperture formed in the at least one wall at a position radially inwardly of the at least one seal slot section.

8. The shroud segment of claim 1, wherein a downstream face of the body is configured to connect to a downstream static nozzle of the turbomachine.

9. A shroud assembly for a turbomachine adapted to be positioned radially outward of a gas flow path of the turbomachine, comprising:

a first shroud segment having a single one-piece first body including:

a first hollow internal pocket for receiving a first supply of air;

at least one first pressurization aperture formed in at least one wall of the single one-piece first body to fluidly connect the first internal pocket to an ambient area of the first body, the at least one first pressurization aperture having an outlet formed in an exterior surface of the at least one wall; and at least one feed hole to provide the supply of air to the first internal pocket, the at least one feed hole formed in an upstream face of the first body, a second shroud segment positioned adjacent the first shroud segment and forming an intersegment cavity therebetween; and a seal positioned in the intersegment cavity at a position radially inwardly of the outlet of the at least one first pressurization aperture, wherein the first body includes an upstream static interface structure connected to an upstream static nozzle of the turbomachine, the upstream static interface structure formed in the upstream face of the first body at a position radially inward of the at least one feed hole, and wherein the first supply of air pressurizes the seal via the at least one first pressurization aperture such that a portion of the first supply of air is configured to flow past the seal as leakage into the gas flow path, thereby reducing ingestion of fluid from the gas flow path into the first internal pocket.

10. The shroud assembly of claim 9, wherein the at least one first pressurization aperture is configured such that a pressure in the first internal pocket is greater than a pressure in a portion of the gas flow path adjacent the first body to facilitate the leakage into the gas flow path.

11. The shroud assembly of claim 10, wherein a size of the at least one first pressurization aperture affects a flow of the first supply of air past the seal.

12. The shroud assembly of claim 11, wherein the at least one first pressurization aperture comprises a plurality of first pressurization apertures.

13. The shroud assembly of claim 12, further comprising a first metering plate positioned in the first internal pocket and having a plurality of first metering holes formed therein.

14. The shroud assembly of claim 13, wherein the first metering plate is arranged such that the first supply of air flows through the first metering holes to control a distribution of the first supply of air to the plurality of first pressurization apertures.

15. The shroud assembly of claim 9, wherein the second shroud segment has a second body and includes:

a second hollow internal pocket for receiving a second supply of air; and at least one second pressurization aperture formed in at least one wall of the second body to fluidly connect the second internal pocket to an ambient area of the second body.

16. The shroud assembly of claim 15, wherein the intersegment cavity includes a first seal slot section formed in the first body and a second seal slot section formed in the second body, wherein a first portion of the seal is positioned in the first seal slot section and a second portion of the seal is positioned in the second seal slot section.

17. The shroud assembly of claim 9, further comprising at least one first cooling aperture formed in the at least one wall of the first body at a position radially inwardly of the seal.

18. A turbomachine, comprising:

a compressor section;

a combustor section; and the shroud assembly of claim 9.

* * * * *